US007210483B1

(12) United States Patent
Lesniak et al.

(10) Patent No.: US 7,210,483 B1
(45) Date of Patent: May 1, 2007

(54) SPORTING PROPHYLAXIS

(75) Inventors: Frank Lesniak, Lansdale, PA (US); Naushirwan R. Mehta, Wellesley, MA (US); Gerard Kugel, Lexington, MA (US); Ayman Aboushala, Malden, MA (US)

(73) Assignee: Medtech Products, Inc., Irvington, NY (US)

( * ) Notice: Subject to any disclaimer, the term of this patent is extended or adjusted under 35 U.S.C. 154(b) by 285 days.

(21) Appl. No.: 10/626,809

(22) Filed: Jul. 25, 2003

(51) Int. Cl.
*A61F 5/56* (2006.01)
*A61G 15/00* (2006.01)
*A61C 17/00* (2006.01)

(52) U.S. Cl. ..... 128/861; 128/859; 433/79; 433/80

(58) Field of Classification Search ..... 128/859, 128/846, 848, 861–862, 48, 856; 433/168.1, 433/79, 6, 80, 37; D24/152, 156.1; 601/164; 600/195

See application file for complete search history.

(56) References Cited

U.S. PATENT DOCUMENTS

| | | | | |
|---|---|---|---|---|
| 3,247,844 | A | 4/1966 | Berghash | |
| 3,496,936 | A | 2/1970 | Gores | |
| 3,505,995 | A | 4/1970 | Greenberg | |
| 4,063,552 | A | 12/1977 | Going et al. | |
| 4,668,188 | A | 5/1987 | Wolfenson et al. | |
| 4,761,136 | A | 8/1988 | Madhavan et al. | |
| 4,955,393 | A | 9/1990 | Adell | |
| 5,328,362 | A | 7/1994 | Watson et al. | |
| 5,339,832 | A | 8/1994 | Kittelsen et al. | |
| 5,406,963 | A | 4/1995 | Adell | |
| 5,566,684 | A | 10/1996 | Wagner | |
| 5,646,216 | A | 7/1997 | Watson et al. | |
| 5,746,221 | A | 5/1998 | Jones et al. | |
| 5,755,233 | A * | 5/1998 | Adell | 128/859 |
| 6,036,487 | A | 3/2000 | Westerman | |
| 6,082,363 | A | 7/2000 | Washburn | |
| 6,170,485 | B1 * | 1/2001 | Orrico | 128/848 |
| 6,302,686 | B1 | 10/2001 | Chott et al. | |
| 6,935,857 | B1 * | 8/2005 | Farrell | 433/6 |
| 2006/0219250 | A1 * | 10/2006 | Farrell | 128/859 |

* cited by examiner

*Primary Examiner*—Justine R. Yu
*Assistant Examiner*—Shumaya B. Ali
(74) *Attorney, Agent, or Firm*—Baker, Donelson, Bearman, Cadwell & Berkowitz, PC

(57) ABSTRACT

An interocclusal sports prophylaxis includes a core having an arch shaped occlusal plate with upwardly extending buccal and lingual walls. A labial force dispersal shield and molar framing braces extend downwardly from the plate at incisor and lingual zones of the plate. The occlusal plate is thickened at the molar and incisor zones so that breathing spaces are provided between mandibular occlusal surfaces not registered with the zones and a mandibular face of the plate. A shock absorption dentition encasement is molded over the upper surface of the core and also covers the molar and incisor zones. The prophylaxis is heated in water, seated in the mouth and then biting pressure is applied to embed the maxillary dentition in the encasement and the lower incisor and molar occlusal surfaces in the encasement covering the zones.

20 Claims, 3 Drawing Sheets

Fig. 4
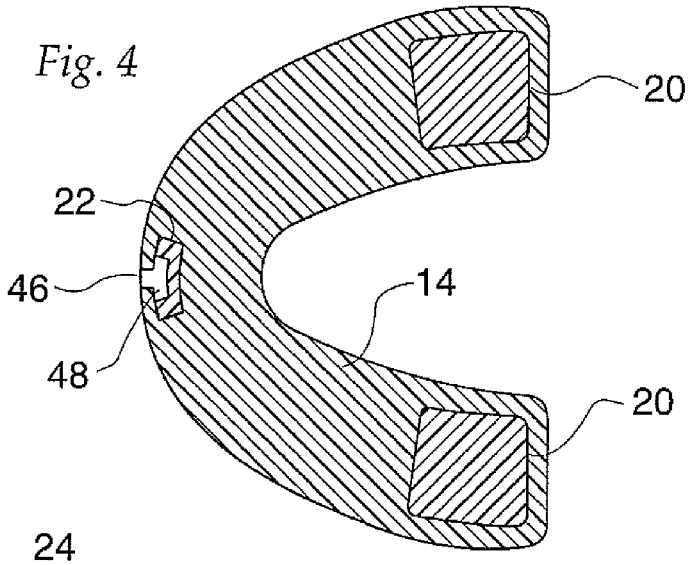
Fig. 8
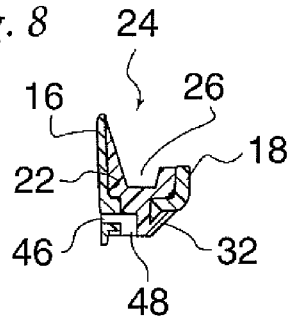
Fig. 7
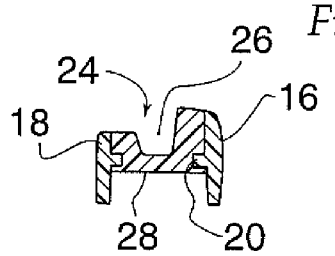
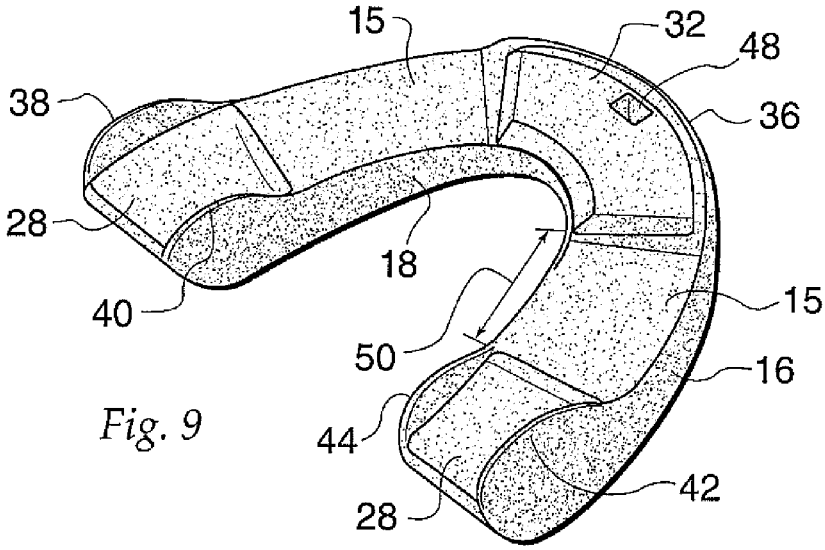
Fig. 9

SPORTING PROPHYLAXIS

BACKGROUND OF THE INVENTION

1. Field of the Invention

This invention relates generally to sporting equipment and more particularly to an interocclusal sports prophylaxis which protects both the upper and lower dentitions, as well as the temporomandibular joint, against impact.

2. Antecedents of the Invention

The earliest mouthguards were introduced in the 1920's for use in boxing and were formed of pieces of rubber cut to the shape of the maxillary arch and held in place by clenching the teeth together. It was difficult, if not impossible to achieve oral airflow because the teeth were required to be clenched together to maintain the mouthguard in position. Oral airflow was crucial, however, as increased levels of oxygen intake were required during physical exertion.

Additionally, early mouthguards were loose fitting and easily displaced upon impact. There was a significant risk of dislodgement and airway obstruction, which was particularly hazardous with reference to boxing, where there was a likelihood of a participant being rendered unconscious.

Improvements over the early rubber mouthguards included a design illustrated in U.S. Pat. No. 2,521,039, issued to Cartheter, which disclosed a rubber mouthguard having a central air passageway. Unfortunately, such mouthguard, too, was kept in place only by clenching and interfered with speech.

Attempts at improving rubber mouthguards lead to the employment of materials capable of conforming to tooth surfaces, including self fitted mouthguards which were immersed in boiling water and then formed in the mouth by biting. Problems encountered with such mouthguards included difficulty in centering the dentition during the self-fitting procedure.

In U.S. Pat. No. 5,566,684, issued to Wagner and assigned to the assignee of the present invention, there is disclosed a molded mouthguard having a thermoplastic channel shaped trough which carried a low softening temperature thermoplastic fill. After heating in boiling water, the mouthguard was inserted into the mouth and the fill conformed to the impression of the upper teeth when biting pressure was applied. Lacking, however, was positive engagement with the mandibular dentition.

In U.S. Pat. No. 5,406,963 issued to Adell, there was provided a mouthguard including a moldable liner which extended into both the upper end lower occlusal surfaces, however, such mouthguard lack the ability to adequately protect the lower dentition against shocks and further inhibited oral breathing, since there was intimate contact of both upper and lower occlusal surfaces with the liner material within which the occlusal surfaces were imbedded.

SUMMARY OF THE INVENTION

An interocclusal sports prophylaxis includes a lattice core with a molded over shock absorption dentition encasement. The core includes an arch shaped occlusal plate bordered by maxillary buccal and lingual walls. Passages extend through the plate at thickened molar and incisor zones on a mandibular face of the plate.

The molded over dentition encasement overlies the upper surface of the core including a maxillary face of the plate and the inner faces of walls and extends through the passages to overly the zones on the mandibular face. The core includes a mandibular force dispersal shield registered with central incisors and lingual and buccal depending molar framing braces registered with each molar zone.

The core is molded of a thermoplastic resin having a Vicat softening temperature of at least 65° C. and a Shore A hardness of at least 85, while the encasement material comprises an EVA copolymer having approximately thirty percent vinyl acetate, a Vicat softening temperature of approximately 36° C. and a Shore A hardness well below 80.

The prophylaxis is fitted by immersion in hot water, such that the encasement material reaches a temperature which is above its softening temperature, yet which can be comfortably withstood by oral tissue. Light pressure is then applied to seat the maxillary occlusal surfaces in a channel formed in the dentition encasement and thereafter, biting pressure is applied to embed the maxillary dentition in the encasement material and simultaneously embed the occlusal surfaces of the lower central incisors and lower molars in the encasement material.

To facilitate mouth breathing, left and right free air-breathing gaps of at least 15 sq mm each are provided between the unembedded mandibular occlusal surfaces and the mandibular face of the plate.

From the foregoing compendium, it will be appreciated that it is an aspect of the present invention to provide an interocclusal sports prophylaxis of the general character described which is not subject to the disadvantages of the antecedents of the invention aforementioned.

A feature of the present invention is to provide an interocclusal sports prophylaxis of the general character described which is particularly well adapted for self fitting.

A consideration of the present invention is to provide an interocclusal sports prophylaxis of the general character described which is well suited for economical mass production fabrication.

A further aspect of the present invention is to provide an interocclusal sports prophylaxis of the general character described which is easy to use.

An additional feature of the present invention is to provide an interocclusal sports prophylaxis of the general character described which affords protection for both mandibular and maxillary incisors against frontal impact.

An additional consideration of the present invention is to provide an interocclusal sports prophylaxis of the general character described which protects the mandibular structure against lateral impact.

A further aspect of the present invention is to provide an interocclusal sports prophylaxis of the general character described which protects the temporomandibular joint against both shock and stress which would otherwise result from sports related impact.

A further feature of the present invention is to provide an interocclusal sports prophylaxis of the general character described which is lightweight and unobtrusive.

It is another aspect of the present invention to provide an interocclusal sports prophylaxis of the general character described fabricated with a shock absorption dentition encasement material molded over a core and which is not subject to shear induced component separation.

A still further feature of the present invention is to provide an interocclusal sports prophylaxis of the general character described which facilitates oral breathing.

To provide an interocclusal sports prophylaxis of the general character described wherein mandibular occlusal surfaces are imbedded in an encasement material only at spaced locations, while an air gap is formed over the remaining mandibular occlusal surfaces to facilitate breathing, is a still further feature of the present invention.

To provide an interocclusal sports prophylaxis of the general character described which includes a core having braces in registration with mandibular molars to protect against lateral impact is a still further consideration of the present invention.

Another feature of the present invention is to provide an interocclusal sports prophylaxis of the general character described having a core formed with thermoplastic polyurethane elastomer and a molded over encasement material formed of ethylene vinyl acetate copolymer and which achieves high component adhesion is a still further aspect of the present invention.

Further aspects, features and considerations of the present invention in part will be obvious and in part will be pointed out hereinafter.

With these ends in view, the invention finds embodiment in the various combinations of elements, arrangements of parts and series of steps by which the aforesaid aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which is shown some of the various exemplary embodiments of the invention.

FIG. 4 is a sectional view through the occlusal plate, the same being taken substantially along the line 4—4 of FIG. 3 and illustrating dentition encasement material extending through passages in the plate;

FIG. 7 is a sectional view through the right molar zone of the prophylaxis, the same being taken substantially along the plane 7—7 of FIG. 1;

FIG. 8 is a sectional view through the incisor area of the prophylaxis, the same being taken substantially along the line 8—8 of FIG. 5; and FIG. 9 is a further underside perspective view of the prophylaxis, similar to FIG. 2, however taken from the rear.

DESCRIPTION OF THE PREFERRED EMBODIMENTS

Figure 1:
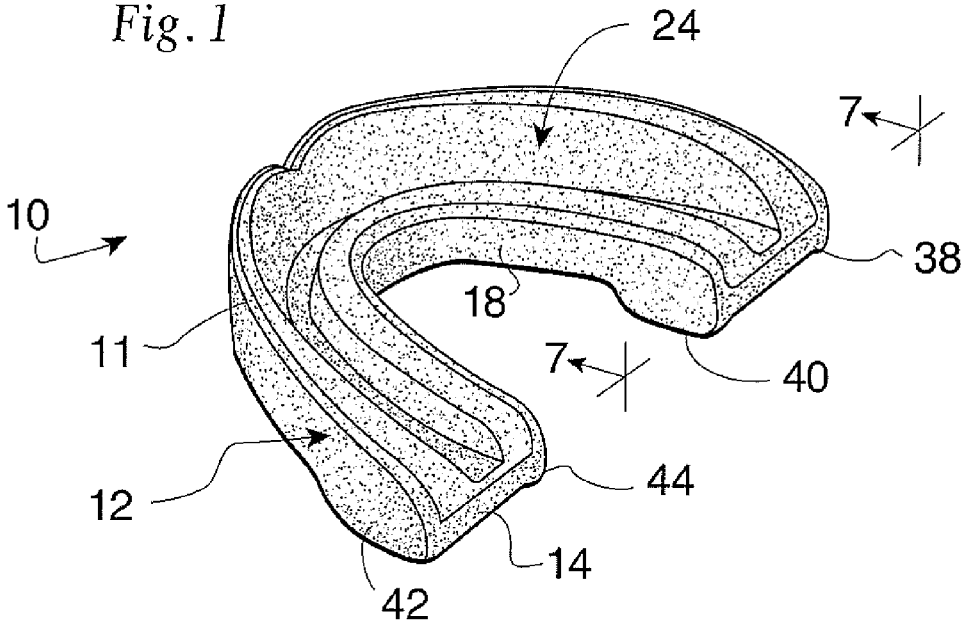
FIG. 1 is a perspective illustration of an interocclusal sports prophylaxis constructed in accordance with and embodying the invention and showing a core, the upper surface of which is covered by a dentition encasement material having a channel for receiving the maxillary dentition during a self fitting procedure.

Referring now in detail to the drawings, the reference numeral 10 denotes generally an interocclusal sports prophylaxis constructed in accordance with and embodying the invention. The prophylaxis 10 includes a lattice core 12 having a substantially planar dental arch shaped occlusal plate 14. The periphery of the upper or maxillary face of the plate is bordered by a buccal side wall 16 and a lingual side wall 18.

The occlusal plate 14 includes a pair of vertical molar passageways 20 and an incisor passageway 22 which extend between the maxillary face of the plate 14 and a lower or mandibular face 15.

Molded over the upper surfaces of the lattice core 12, i.e. the maxillary face of the plate 14 and the internal faces of the side walls 16, 18, is a shock absorption dentition encasement 24 formed or an EVA copolymer. A dental arch shaped channel 26 is formed on the upper surface of the encasement 24. The channel 26 serves as a guide for receiving the maxillary occlusal surfaces during a self fitting procedure, as will be explained in detail hereinafter. The EVA copolymer material of which the dentition encasement is formed extends through the passageways 20 and 22 such that an encasement layer 28 overlies a thickened molar zone or pedestal 30 which lies in a plane beneath the plane of the mandibular face 15. Similarly, the dentition encasement material extends through the incisor passageway 22 and an encasement layer 32 overlies a sloped thickened incisor zone 34 or pedestal which is positioned beneath the plane of the mandibular face 15.

As mentioned, the thickened molar zones or pedestals 30 include lower faces, each of which extends substantially parallel to the plane of the mandibular face 15. With the occlusal plate 14 having a thickness in the order of, for example, 1–2 mm, the thickness of the plate 14 at the molar zones would be in the order of 2–3 mm. That is, the plane of the face of the pedestals is approximately 1 mm below the plane of the mandibular face 15.

Figure 2:
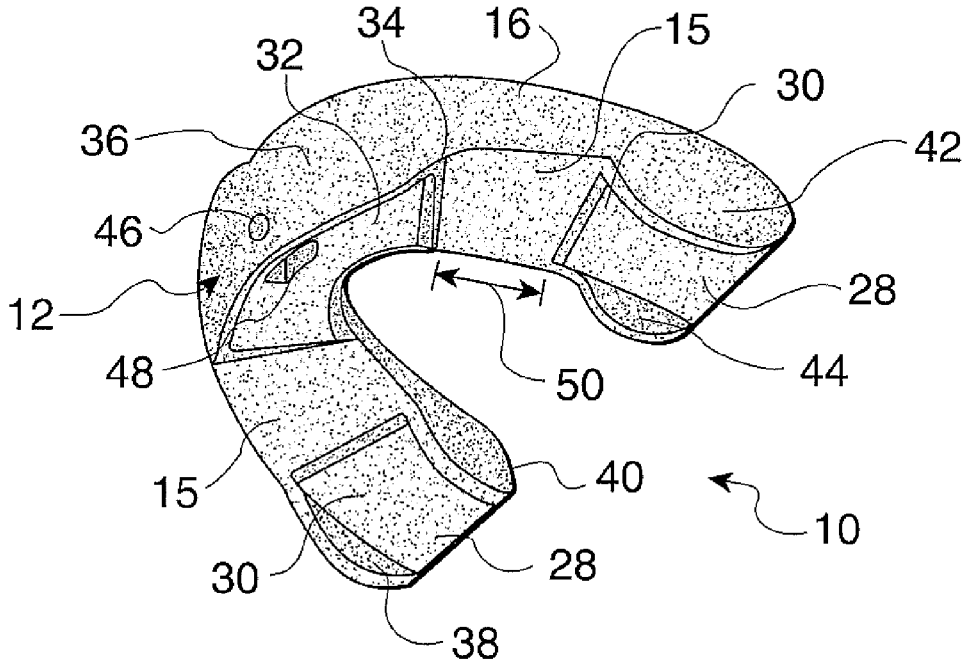
FIG. 2 is an underside perspective view of the interocclusal sports prophylaxis and showing a depending incisor force dispersal shield as well as a mandibular face of an occlusal plate of the core, with the face having thickened molar and incisor zones and with the core including framing braces at the molar zone.
Figure 3:
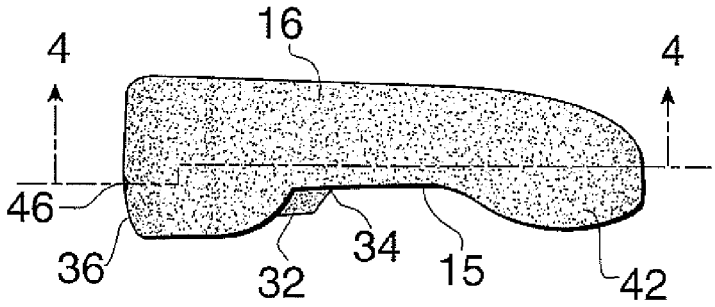
FIG. 3 is a left side view of the prophylaxis, illustrating the incisor force dispersal shield and a buccal molar framing brace.
Figure 5:
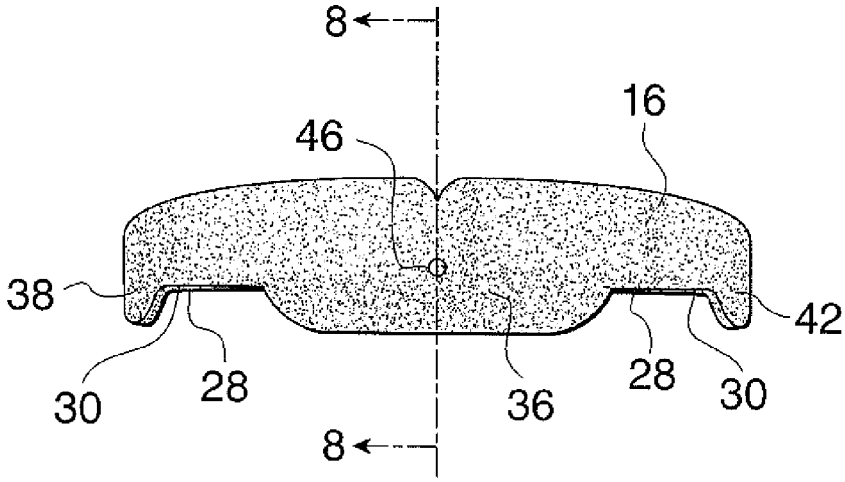
FIG. 5 is a front elevational view of the prophylaxis.
Figure 6:
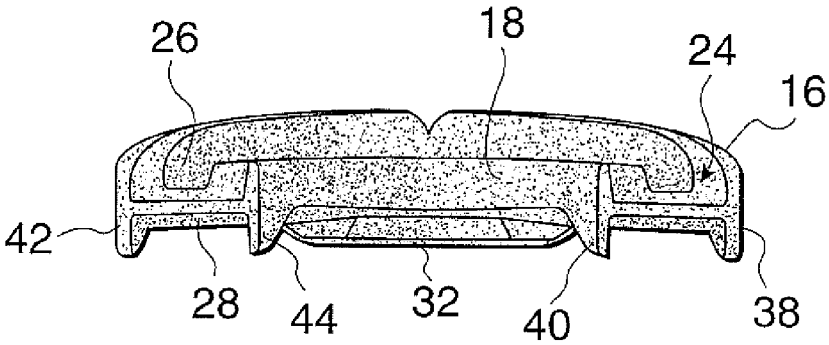
FIG. 6 is a rear elevational view thereof.

The thickness of the occlusal plate 14 at the incisor zone 34 is tapered or sloped from a maximum thickness at a labial force dispersal shield 36 (which is registered with an incisor area of the buccal wall 16) to a minimum thickness at a lingual bight as illustrated in FIG. 2 and FIG. 6. The thickness of the occlusal plate 14 at the incisor zone 34, at the point where contact with the mandibular incisors is expected to take place, is in the order of 3 to 5 mm, with the contact point lying in a plane approximately between 1 mm and 4 mm below the plane of the mandibular face 15.

Registered with the buccal wall 16 and the lingual wall 18 at the molar zones 30 are depending right molar framing braces 38, 40 and left molar framing braces 42, 44.

Pursuant to the invention, the right and left molar framing braces overly the buccal and lingual walls of the molars and thus serve to lock the mandible in place relative to the maxillary dentition in the presence of lateral blows which may be encountered during sporting events.

It should also be noted that a central aperture 46 extends through the force dispersal shield 36 and into a hollow companion well 48 molded in the incisor encasement layer 32 for the purpose of anchoring a tether strap which may be optionally 9' utilized for attachment of the prophylaxis to a helmet component such as a cage or guard. A knot or enlarged end of the tether seats in the well 48.

The core 12 and the dentition encasement 24 are bonded to form a unitary prophylaxis which is fitted by immersion in hot water, such that the encasement material reaches a temperature above its softening temperature, yet which can be comfortably withstood by oral tissue. The prophylaxis is thereafter inserted into the oral cavity with the channel 26 substantially registered with the maxillary dentition.

Light pressure is applied to seat the maxillary dentition in the channel 26 after which biting pressure is applied to embed the maxillary teeth in the dentition encasement and to embed the molar and incisor occlusal surfaces of the mandibular dentition in the molar and incisor layers, 28, 32 which overlie the respective molar and incisor zones. The biting pressure is sufficient to displace the dentition encasement material such that the maxillary occlusal surfaces essentially abut the maxillary face of the occlusal plate 14 and the occlusal incisor and molar surfaces of the mandibular dentition abut the respective thickened molar and incisor zones 30, 34, formed on the mandibular face 15.

It should be appreciated that a mouth breathing air gap exists between the mandibular face 15 of the occlusal plate 14 and the lower cuspids, first bicuspids, second bicuspids and possibly first molars, when while the occlusal surfaces of the central and lateral incisors and second and third molars are embedded in the layers of encasement material which cover the respective thickened zones 30, 34.

There is a minimum distance 50 between each molar zone 30 and the incisor zone 34 in the order of 1.5 cm. With the thickness of the occlusal plate 14 at molar zones being in the order of 1 mm greater than the normal thickness of the occlusal plate 14 and the average thickness of the incisor zone 34 being in the order of 2 mm greater than the normal thickness of the occlusal plate 14, there is provided a minimum left and right free air breathing space between the mandibular occlusal surfaces and the mandibular face 15 of at least 15 sq. mm on both the left and the right sides, which results in a minimum total free air breathing space of at least 30 sq. mm.

It is significant that the thermoplastic material selected for the core has a softening temperature sufficiently above that of the dental encasement material such that the occlusal plate thickness at the molar zones and the incisor zone is not significantly reduced as a result of the compressor forces generated during the fitting procedure.

The rheological characteristics of the thermoplastic material from which the core 12 is fabricated include a Vicat softening temperature (ASTM D1525) of at least 65° C., which is well above the temperatures encountered during the fitting procedure, e.g. 40° C. to 45° C.

In accordance with the invention, the lattice core 12 is formed by injection molding of a thermoplastic resin have requisite characteristics into a mold cavity. The lattice core 12 is then positioned in a prophylaxis mold cavity and a thermoplastic resin material having the requisite characteristics for the dentition encasement is injected into the prophylaxis mold cavity over the core 12 and unitarily bonds thereto.

Suitable resins for employment as the dentition encasement material include an ethylene vinyl acetate (EVA) copolymer available from DuPont under the trademark ELVAX® having a vinyl acetate content of at least 25%. A preferred EVA copolymer is ELVAX® 150 having a 33% vinyl acetate content by weight, a Vicat softening temperature of 36° C. and a Shore A hardness of 73.

Preferred embodiments of the invention may be fabricated in accordance with the following examples:

EXAMPLE No. 1

A lattice core 12 was injection molded utilizing the following resin formulation:

| CORE RESIN | PERCENTAGE BY WEIGHT |
|---|---|
| PELLETHANE ® 2103 - 90 A TPU elastomer | 90% |
| ELVAX ® 750 EVA | 10% |

PELLETHANE®2103-90 A comprises a thermoplastic polyurethane elastomer available from Dow Chemical Co. and ELVAX®750 EVA comprises an ethylene vinyl acetate copolymer available from DuPont and having a 9% vinyl acetate content by weight.

Ninety percent by weight PELLETHANE®2103-90 A was blended with 10% ELVAX®750 EVA by conventional apparatus such as a twin screw extruder, then pelletized. The blended pellets were then heated to a suitable molding temperature and thereafter molded into the lattice core mold cavity. The molded lattice core 12 exhibited a Shore A hardness of 90±1 and a Vicat softening temperature above 65° C.

The molded lattice core 12 was then inserted into a prophylaxis mold cavity and the following thermoplastic resin was utilized as the dentition encasement material:

| DENTITION ENCASEMENT RESIN | PERCENTAGE BY WEIGHT |
|---|---|
| ELVAX ® 150 EVA | 100% |

The ELVAX®150 EVA encasement resin was heated to a suitable molding temperature and injection molded into a prophylaxis mold cavity, after the molded lattice core 12 had been positioned in the cavity.

The prophylaxis was removed from the mold cavity and exhibited a good adhesion between the lattice core and the dentition encasement.

The prophylaxis of EXAMPLE No. 1 was heated by immersion in boiling water for approximately 40 seconds, removed from the boiling water and immersed in water at or below room temperature for approximately 1 second. The prophylaxis was then inserted into the oral cavity and the maxillary occlusal surfaces were seated in the channel 26. Thereafter biting pressure was applied and the maxillary teeth were impressed into the dentition encasement. The encasement material flowed over, around and conformed to the shape of the surfaces of the maxillary dentition.

Simultaneously, the dentition encasement material in the molar layers 28 and the incisor layer 32 flowed over and around and conformed to the shape of the occlusal surfaces of the central and lateral incisors and second and third molars, leaving a free air gap between the remaining mandibular occlusal surfaces and the mandibular face 15. Both the maxillary and mandibular occlusal surfaces contacted the occlusal plate 14 of the core 12, having displaced the heated dentition encasement material. After fitting in the oral cavity in accordance with the invention, the free air gaps provided an adequate airway passage for mouth breathing, as would be required for increased oxygen intake during sporting activities.

EXAMPLE No. 2

A lattice core 12 was injection molded utilizing the following resin formulation:

| CORE RESIN | PERCENTAGE BY WEIGHT |
|---|---|
| PELLETHANE ® 2103 - 90 A TPU elastomer | 90% |
| ELVALOY 1609 ® 1609 AC EMA | 10% |

Ninety percent by weight PELLETHANE® 2103-90 A was blended with 10% ELVALOY® 1609 AC ethylene methyl acrylate copolymer (available from DuPont) with conventional blending apparatus, by way of example, a twin screw extruder. The blended components were thereafter pelletized. The pellets were heated to a suitable molding temperature and injection molded into the lattice core mold cavity. The molded core exhibited a Shore A hardness of 90±1 and a Vicat softening temperature above 65° C.

The molded core 12 was then inserted into a prophylaxis mold cavity and the following resin was utilized as the dentition encasement material.

| DENTITION ENCASEMENT RESIN | PERCENTAGE BY WEIGHT |
|---|---|
| ELVAX ® 150 EVA | 100% |

The ELVAX® 150 EVA was heated to a recommended molding temperature above its melting point and injection molded into the prophylaxis mold cavity over the molded core 12.

The prophylaxis was removed from the mold cavity and exhibited a good adhesion bond between the dentition encasement and the lattice core.

The prophylaxis of EXAMPLE No. 2 was heated by immersion in boiling water for approximately 40 seconds, removed from the boiling water and immersed in water at or below room temperature for approximately 1 second. The prophylaxis was then inserted into the oral cavity and the maxillary occlusal surfaces were seated in the channel 26. Thereafter, biting pressure was applied and the maxillary teeth were impressed into the dentition encasement. The encasement material flowed over, around and conformed to the shape of the surfaces of the maxillary dentition.

Simultaneously, the dentition encasement material in the molar layers 28 and the incisor layer 32 flowed over and around and conformed to the shape of the occlusal surfaces of the central and lateral incisors and second and third molars, leaving a free air gap between the remaining mandibular occlusal surfaces and the mandibular face 15. Both the maxillary and mandibular occlusal surfaces contacted the occlusal plate 14 of the core 12, having displaced the heated dentition encasement material. After fitting in the oral cavity in accordance with the invention, the free air gaps provided an adequate airway passage for mouth breathing, as would be required for increased oxygen intake during sporting activities.

EXAMPLE No. 3

A base 12 was injection molded utilizing the following resin formulation:

| CORE RESIN | PERCENTAGE BY WEIGHT |
|---|---|
| ELVALOY ® 1609 AC EMA | 100% |

ELVALOY®1609 AC EMA was heated to a suitable molding temperature and thereafter injection molded into the core mold cavity. The molded core 12 exhibited a Shore A hardness of 90 and a Vicat softening temperature of 70° C. is specified by the manufacturer.

The molded core 12 was then inserted into an interocclusal sports prophylaxis mold cavity and the following thermoplastic resin was utilized as the impression preform:

| DENTITION ENCASEMENT RESIN | PERCENTAGE BY WEIGHT |
|---|---|
| ELVAX ® 150 EVA | 100% |

The ELVAX®150 EVA was heated to a recommended molding temperature above its melting point and injection molded into the interocclusal sports prophylaxis mold cavity over the molded core.

The prophylaxis was removed from the mold cavity and exhibited a good adhesion between the lattice core and the dentition encasement.

The prophylaxis of EXAMPLE No. 3 was heated by immersion in boiling water for approximately 40 seconds, removed from the boiling water and immersed in water at or below room temperature for approximately 1 second. The prophylaxis was then inserted into the oral cavity and the maxillary occlusal surfaces were seated in the channel 26. Thereafter, biting pressure was applied and the maxillary teeth were impressed into the dentition encasement. The encasement material flowed over, around and conformed to the shape of the surfaces of the maxillary dentition.

Simultaneously, the dentition encasement material in the molar layers 28 and the incisor layer 32 flowed over and around and conformed to the shape of the occlusal surfaces of the central and lateral incisors and second and third molars, leaving a free air gap between the remaining mandibular occlusal surfaces and the mandibular face 15. Both the maxillary and mandibular occlusal surfaces contacted the occlusal plate 14 of the core 12, having displaced the heated dentition encasement material. After fitting in the oral cavity in accordance with the invention, the free air gaps provided an adequate airway passage for mouth breathing, as would be required for increased oxygen intake during sporting activities.

EXAMPLE No. 4

A core 12 was injection molded utilizing the following resin formulation:

| CORE RESIN | PERCENTAGE BY WEIGHT |
|---|---|
| ELVAX ® 750 EVA | 100% |

ELVAX®750 EVA was heated to a suitable molding temperature and thereafter injection molded into the core mold cavity. The molded base 12 exhibited a Shore A hardness of 92 and a Vicat softening temperature of 75° C. is specified by the manufacturer.

The prophylaxis was removed from the mold cavity and exhibited a good adhesion between the lattice core and the dentition encasement.

The prophylaxis of EXAMPLE No. 4 was heated by immersion in boiling water for approximately 40 seconds, removed from the boiling water and immersed in water at or below room temperature for approximately 1 second. The prophylaxis was then inserted into the oral cavity and the maxillary occlusal surfaces were seated in the channel 26. Thereafter, biting pressure was applied and the maxillary teeth were impressed into the dentition encasement. The encasement material flowed over, around and conformed to the shape of the surfaces of the maxillary dentition.

Simultaneously, the dentition encasement material in the molar layers 28 and the incisor layer 32 flowed over and around and conformed to the shape of the occlusal surfaces of the central and lateral incisors and second and third molars, leaving a free air gap between the remaining mandibular occlusal surfaces and the mandibular face 15. Both the maxillary and mandibular occlusal surfaces contacted the occlusal plate 14 of the core 12, having displaced the heated dentition encasement material. After fitting in the oral cavity in accordance with the invention, the free air gaps provided an adequate airway passage for mouth breathing, as would be required for increased oxygen intake during sporting activities.

EXAMPLE No. 5

A core 12 was injection molded utilizing the following resin formulation:

| CORE RESIN | PERCENTAGE BY WEIGHT |
|---|---|
| ELVALOY ® 1609 AC EMA | 50% |
| PELLETHANE ® 2103-90 A TPU | 50% |

Fifty percent (50%) ELVALOY®1609 AC by weight is blended with fifty percent (50%) PELLETHANE®2103-90 A. The blend was heated to a suitable molding temperature and thereafter injection molded into the core mold cavity. Molded core 12 exhibited a Shore A hardness of 95 and a Vicat softening temperature above 65° C.

The molded core 12 was then inserted into an interocclusal sports prophylaxis mold cavity and the following thermoplastic resin was utilized as the encasement material:

| PREFORM RESIN | PERCENTAGE BY WEIGHT |
|---|---|
| ELVAX ® 150 EVA | 100% |

The prophylaxis was removed from the mold cavity and exhibited a good adhesion between the lattice core and the dentition encasement.

The prophylaxis of EXAMPLE No. 5 was heated by immersion in boiling water for approximately 40 seconds, removed from the boiling water and immersed in water at or below room temperature for approximately 1 second. The prophylaxis was then inserted into the oral cavity, with the maxillary occlusal surfaces were seated in the channel 26. Thereafter, biting pressure was applied and the maxillary teeth were impressed into the dentition encasement. The encasement material flowed over, around and conformed to the shape of the surfaces of the maxillary dentition.

Simultaneously, the dentition encasement material in the molar layers 28 and the incisor layer 32 flowed over and around and conformed to the shape of the occlusal surfaces of the central and lateral incisors and second and third molars, leaving a free air gap between the remaining mandibular occlusal surfaces and the mandibular face 15. Both the maxillary and mandibular occlusal surfaces contacted the occlusal plate 14 of the core 12, having displaced the heated dentition encasement material. After fitting in the oral cavity in accordance with the invention, the free air gaps provided an adequate airway passage for mouth breathing as would be required for increased oxygen intake during sporting activities.

Other suitable core resin formulations may comprise 100% ELVALOY® 1609 AC EMA, 100% ELVAX® 750 EVA, blends of ELVALOY® 1609 AC EMA and PELLETHANE® 2103-90 A TPU ranging between 10% to 90%, ELVALOY® 1609 AC EMA by weight, and blends of ELVAX® 750 EVA and PELLETHANE® 2103-90A TPU ranging between 90% to 10% ELVAX® 750 EVA by weight. Additional core resin formulations may comprise linear low density polyethylene (LLDPE), low density polyethylene (LDPE) or blends of ELVAX 750 EVA and LLDPE or LDPE with the LLDPE or LDPE content ranging from 25% to 90% by weight as well as 100% SANTOPRENE® 8000 Rubber (8281-90) having a Shore A hardness of 90.

It should be appreciated that the foregoing is merely exemplary and various other and alternate thermoplastic resins may be selected for use in accordance with the invention. The principal rheological and other attributes of the selected resins include a suitable softening temperature range for the encasement material resin which will not create temperature induced discomfort or damage to oral tissue, together with a softening temperature range and hardness of the core resin such that substantial deformation of the core does not occur during fitting and over prolonged usage.

Thus it will be seen that there is provided an interocclusal appliance which achieves the various aspects, features and considerations of the present invention and which is well-suited to meet the conditions of practical usage.

Since various possible embodiments might be made of the present invention and since various changes might be made in the exemplary embodiments shown herein,

Having thus described the invention there is claimed as new and desired to be secured by Letters Patent:

1. An interoccusal sports prophylaxis comprising a core, the core including an arch shaped occlusal plate, maxillary buccal and lingual walls extending upwardly from the occlusal plate, a dentition encasement material covering the upper surface of the occlusal plate and inner faces of the maxillary buccal and lingual walls, the occlusal plate including a generally planar lower mandibular face, the dentition encasement material covering selected zones of the lower mandibular face, the selected zones being spaced from one another along the mandibular face, the occlusal plate extending below the plane of the mandibular face at the selected zones, the core including passages through the occlusal plate transverse to the plane of the mandibular face at the selected zones, the dentition encasement material covering the upper surface of the occlusal plate and the selected zones extending through the passages, the dentition encasement material conforming to the shape of tooth surfaces after the prophylaxis is fitted and when the prophylaxis is worn, whereby mandibular occlusal surfaces not registered with the selected zones are spaced from the mandibular face to provide oral breathing passages between mandibular tooth surfaces and the mandibular face when the prophylaxis is worn.

2. An interocclusal sports prophylaxis as constructed in accordance with claim 1 wherein the dentition encasement material is molded to the core.

3. An interocclusal sports prophylaxis as constructed in accordance with claim 1 wherein the occlusal plate extends below the plane of the mandibular face a distance in the order of at least one mm at the selected zones.

4. An interocclusal sports prophylaxis as constructed in accordance with claim 3 wherein one of the selected zones is an incisor zone and the occlusal plate extends below the plane of the mandibular face a distance in the order of two mm at the incisor zone.

5. An interocclusal sports prophylaxis as constructed in accordance with claim 1 wherein the core comprises a resin which includes a thermoplastic polyurethane elastomer.

6. An interocclusal sports prophylaxis as constructed in accordance with claim 5 wherein the thermoplastic polyurethane elastomer is blended with a thermoplastic selected from the group consisting of ethylene vinyl acetate copolymer and ethylene methyl acrylate copolymer.

7. An interocclusal sports prophylaxis as constructed in accordance with claim 5 wherein the resin comprises 90% by weight thermoplastic polyurethane elastomer and 10% by weight ethylene vinyl acetate copolymer.

8. An interocclusal sports prophylaxis as constructed in accordance with claim 5 wherein the resin comprises 90% by weight thermoplastic polyurethane elastomer and 10% by weight ethylene methyl acrylate copolymer.

9. An interocclusal sports prophylaxis as constructed in accordance with claim 1 wherein the core comprises a resin having a Shore A hardness of at least 85 and a Vicat softening temperature of at least 65° C. and the dentition encasement material comprises a resin having a Shore A hardness below 80 and a Vicat softening temperature of approximately 36° C.

10. An interocclusal sports prophylaxis as constructed in accordance with claim 1 wherein the breathing passages comprise not less than 30 sq. mm.

11. An interocclusal sports prophylaxis as constructed in accordance with claim 1 wherein there are three selected zones, a pair of molar zones and one incisor zone and the minimum distance between the molar zones and the incisor zone is in the order of 1.5 cm.

12. An interocclusal sports prophylaxis comprising a core, the core including an arch shaped occlusal plate, maxillary buccal and lingual walls extending upwardly from the periphery of the occlusal plate, a dentition encasement material covering the upper surface of the occlusal plate and inner faces of the maxillary buccal and lingual walls, the occlusal plate including a generally planar lower mandibular face, the core including a labial force dispersal shield extending downwardly from a peripheral portion of the occlusal plate to protect a user's incisor mandibular structure against frontal blows during sporting activities, the mandibular face having a pair of molar zones in registration with mandibular molar teeth of the user, the core further including a pair of opposed peripheral framing braces, each framing brace extending downwardly from a buccal periphery of the mandibular face at the molar zones to protect the user's mandibular structure against lateral blows encountered during sporting activities, the buccal periphery of the mandibular face being free of downward extensions intermediate the labial force dispersal shield and the framing braces to facilitate oral breathing.

13. An interocclusal sports prophylaxis as constructed in accordance with claim 12 wherein the dentition encasement material covers the molar zones and an incisor zone of the mandibular face, the incisor zone being registered with the labial force dispersal shield.

14. An interocclusal sports prophylaxis as constructed in accordance with claim 12 wherein the mandibular face further includes an incisor zone, the incisor zone and the molar zones extending below a plane of the mandibular face, whereby mandibular occlusal surfaces of a user not registered with the incisor zone and the molar zones are spaced from the mandibular face to provide opposed oral breathing passages when the prophylaxis is worn.

15. A method of fabricating an interocclusal sports prophylaxis, the method including the steps of:

a) providing a first thermoplastic resin, b) molding from the first thermoplastic resin, a core having an arch shaped occlusal plate with a buccal periphery, a lingual periphery and maxillary buccal and lingual walls extending upwardly from the buccal and lingual peripheries of the plate, the buccal and lingual walls being dimensioned for substantial registration with a user's maxillary dentition, a labial force dispersal shield extending downwardly from the buccal periphy of the plate at an incisor zone and a pair of spaced opposed molar framing braces extending downwardly from buccal and lingual peripheries of the plate at left and right molar zones of the plate, the force dispersal shield and the molar framing braces being dimensioned to overlie the user's incisor and molar teeth respectively, the periphery of the plate being free of downward extensions intermediate the labial force dispersal shield and the framing braces, c) providing a dentition encasement material from a second thermoplastic resin having a Vicat softening temperature and a hardness lower than that of the first thermoplastic resin, and d) molding the dentition encasement material over selected areas of the core.

16. A method of providing an interocclusal sports prophylaxis in accordance with claim 15 wherein the first thermoplastic resin is provided by blending a thermoplastic polyurethane elastomer with a thermoplastic selected from the group consisting of ethylene vinyl acetate copolymer and ethylene methyl acetate copolymer.

17. A method of providing an interocclusal sports prophylaxis in accordance with claim 15 wherein the second thermoplastic resin comprises an ethylene vinyl acetate copolymer.

18. A method of providing an interocclusal sports prophylaxis in accordance with claim 15 wherein step d) is performed by molding the dentition encasement material over maxillary surfaces of the occlusal plate.

19. A method of providing an interocclusal sports prophylaxis in accordance with claim 18 wherein step d) is performed by molding the dentition encasement material over mandibular surfaces of the occlusal plate at the incisor zone and at the molar zones.

20. A method of providing an interocclusal sports prophylaxis in accordance with claim 19 wherein the occlusal plate includes passages extending between maxillary surfaces and mandibular surfaces at the incisor zone and at the molar zones and step d) is performed by molding the dentition encasement material into the passages to unite the dentition encasement material molded over the maxillary surfaces of the occlusal plate with the dentition encasement material molded over the mandibular surfaces of the occlusal plate.

* * * * *